US011753202B2

(12) United States Patent
Baner et al.

(10) Patent No.: US 11,753,202 B2
(45) Date of Patent: Sep. 12, 2023

(54) PACKAGING CONTAINERS, SYSTEMS, AND METHODS

(71) Applicant: Société des Produits Nestlé S.A., Vevey (CH)

(72) Inventors: Albert Lawrence Baner, Wildwood, MO (US); Timothy Gleason, Manchester, MO (US)

(73) Assignee: SOCIÉTÉ DES PRODUITS NESTLÉ S.A., Vevey (CH)

( * ) Notice: Subject to any disclaimer, the term of this patent is extended or adjusted under 35 U.S.C. 154(b) by 148 days.

(21) Appl. No.: 16/992,283

(22) Filed: Aug. 13, 2020

(65) Prior Publication Data

US 2021/0053719 A1 Feb. 25, 2021

Related U.S. Application Data

(60) Provisional application No. 62/891,019, filed on Aug. 23, 2019.

(51) Int. Cl.

| | |
|---|---|
| ***B65D 5/54*** | (2006.01) |
| ***B65D 5/42*** | (2006.01) |
| ***B65D 5/468*** | (2006.01) |
| ***B65D 5/60*** | (2006.01) |

(52) U.S. Cl.

CPC ..... *B65D 5/54* (2013.01); *B65D 5/4212* (2013.01); *B65D 5/4608* (2013.01); *B65D 5/60* (2013.01); *B65D 2203/00* (2013.01)

(58) Field of Classification Search

CPC ..... B65D 5/60; B65D 5/4608; B65D 5/4212; B65D 5/54; B65D 5/541; B65D 5/0227; B65D 5/0236; B65D 5/0254; B65D 5/5415; B65D 5/5455

USPC ..... 229/240, 222, 212, 102, 121, 123.3, 229/125.08, 132, 223, 229

See application file for complete search history.

(56) References Cited

U.S. PATENT DOCUMENTS

| | | | | | |
|---|---|---|---|---|---|
| RE26,107 | E * | 11/1966 | Rasmussen et al. | ... | B65D 5/541 229/240 |
| 3,580,483 | A | 5/1971 | Young | | |
| 5,746,371 | A * | 5/1998 | Ben-Haim | ..... | B65D 5/5415 229/122 |
| 6,024,219 | A * | 2/2000 | Froehlich | ..... | B65D 5/4204 220/665 |
| 6,471,120 | B1 | 10/2002 | Vogel | | |
| 6,889,892 | B2 * | 5/2005 | Walsh | ..... | B65D 5/744 229/229 |
| 7,984,844 | B2 * | 7/2011 | Jones | ..... | B65D 5/744 229/219 |
| 10,124,947 | B2 * | 11/2018 | Pinkstone | ..... | B65D 5/563 |

(Continued)

OTHER PUBLICATIONS of International Search Report and Written Opinion to Appl. No. PCT/IB2020/057629 dated Oct. 15, 2020.

*Primary Examiner* — Christopher R Demeree

(57) ABSTRACT

A system or method for packaging is disclosed including a packaging container with one or more flaps, optionally a packaging liner, one or more carrying handles on the packaging container, a first tear strip located on a top face of the packaging container, a second tear strip located on a bottom face of the packaging container, and one or more tabs located on the first and second tear strips. The system or method may include the use of a remnant flap on the top face of the packaging container to retain the packaging container in a closed position.

17 Claims, 16 Drawing Sheets

(56) References Cited

U.S. PATENT DOCUMENTS

| | | | | |
|---|---|---|---|---|
| 10,239,651 | B2 * | 3/2019 | Exner | B31B 50/262 |
| 10,322,844 | B2 * | 6/2019 | Boersma | B65D 5/5076 |
| 11,330,874 | B2 * | 5/2022 | Kyung | A44C 5/14 |
| 11,332,274 | B2 * | 5/2022 | Sollie | B65D 5/54 |
| 2019/0135516 | A1 | 5/2019 | Mabrey | |

* cited by examiner

PACKAGING CONTAINERS, SYSTEMS, AND METHODS

CROSS REFERENCE TO RELATED APPLICATIONS

This application claims priority to U.S. Provisional Application Ser. No. 62/891,019 filed Aug. 23, 2019, the disclosure of which is incorporated in its entirety herein by this reference.

TECHNICAL FIELD

The present disclosure relates generally to methods and devices for packaging systems. More specifically, the present disclosure relates to methods and devices for packaging systems for shipping products.

BACKGROUND

E-commerce is a quickly growing retail channel. E-commerce may require the use of packaging systems to ship products from a seller to a consumer. Sellers using packaging systems may require reduced cost packaging systems and/or better protection of products while shipping in new packaging systems. Moreover, consumers desire packages that are easy to pick up and handle.

Existing shipping containers may be too expensive, difficult to use or manage by the consumer, use material in an inefficient or wasteful manner, or require extra handling steps. For example, many shipping containers require a second, oversized corrugated shipping container, optionally provided with dunnage (e.g., paper and/or plastic pillows) to ship a product. These shipping containers further require additional, labor intensive, manual packaging procedures. Accordingly, delivery-to-disposal containers are desired that reduce end-to-end cost and benefit consumers.

SUMMARY

The present disclosure provides advantages and solutions to problems in existing technologies for methods and devices for packaging containers and systems. In this regard, methods and devices for packaging containers and systems are provided herein. A packaging system can be provided with a packaging liner and a packaging container. When the packaging container is assembled, the packaging liner can be inserted into the packaging container and filled with a product. The packaging container may comprise a tear strip comprising a tear tape and/or a perforated strip on a top face of the packaging container configured to provide an easy to use, tool-free ability to open the packaging container. In a non-limiting particular embodiment, the packaging container further comprises a remnant flap to enclose a flap of the packaging container. Additionally, a tear strip can be provided on a bottom face of the packaging container to ease in breaking down the packaging container after use.

In an embodiment, a packaging container or system for shipping a product is provided herein. For example, the product is purchased by a consumer on an e-commerce website before being shipped to the consumer using the packaging container or system. The product may be a pet food and/or a pet litter. In an embodiment, a packaging container or system that reduces costs is provided herein. For example, a packaging container or system that reduces wasteful and inefficient use of material is provided herein. In an embodiment, a ship-in-own-container packaging container or system is provided herein that does not require a second, oversized corrugated shipping container.

The packaging container or system may be configured to be placed in an upright vertical package orientation. The upright vertical package orientation can be configured to display the packaging container or system on a smallest side of the packaging container or system and/or be carried in a vertical upright position. In an embodiment, a packaging system includes a packaging container. The packaging container can be made of a corrugated fiberboard or paper board. The packaging container can optionally include one or more carrying handles.

In an embodiment, a packaging container or system includes a tear strip comprising a tear tape and/or a perforated strip on a top face of the packaging container or system configured to provide an easy to use, tool-free packaging container or system opening experience. The location of the tear strip on the top of the packaging container or system is an obvious visual location for a consumer in an embodiment when the packaging container or system is oriented in a vertical upright position. The tear strip of a packaging container or system may include a tab on one or each respective ends of the tear strip, the tab configured to provide a finger hold for pulling back the tear strip. In an embodiment, a packaging container or system can include an additional tear strip located on the bottom face of the packaging container or system, opposite the top face. In such an embodiment, the packaging container or system is configured to breakdown and/or flatten without tools and/or requiring traditional container breakdown and/or flattening methods. In an embodiment, the tear strips on the top and bottom face of the packaging container or system are oriented in the same direction. Alternatively, the tear strips on the top and bottom face of the packaging container or system are oriented in opposite directions.

In an embodiment, a top of the packaging container or system is configured to be reclosed after the top is opened by a consumer, and additionally or alternatively includes a remnant flap formed by removal of the tear strip; the remnant flap configured to partially enclose one or more flaps of the packaging container such that the one or more flaps of the packaging container are positioned under the remnant flap for retaining the top of the packaging container in a closed position. In an embodiment, when the tear strip is removed by a consumer a full-width flap forms and a remnant flap forms. In such an embodiment, the full-width flap forms a hinged lid configured to fold away from the remaining portion of the packaging container, therefore allowing the consumer to easily dispense the product by pouring or scooping the product from within the packaging system. In such an embodiment, the remnant flap forms a fold-over flap configured to partially enclose the full-width flap, therefore restraining the full-width flap from rising. As such, if the consumer chooses to store an opened (i.e., unsealed) product in the packaging container or system, the hinged lid is configured to be positioned underneath a remnant flap to prevent the lid from easily and/or accidentally being flipped up.

In an embodiment, the packaging system can include a packaging liner. The packaging liner may seal odors from the product within the packaging liner, and can substantially restrict such odors from reaching the consumer.

A method for assembling a packaging container or system is disclosed herein. In an embodiment, a method for assembling a packaging container can include the steps of folding bottom flaps of the packaging container to enclose the bottom of the container, sealing the bottom flaps, folding the top flaps of the packaging container, and sealing the top flaps. In one aspect, a method for assembling a packaging system can include the above steps and can further include inserting a packaging liner before sealing the top or bottom flaps. In another aspect, the method can further include filling the packaging liner with a product. In still another aspect, the method can further include sealing the packaging liner. Another method would be to take a pre-filled liner or bag and insert it into the container after sealing the bottom flaps and prior to sealing the top flaps.

In another embodiment, a method for assembling a packaging container can include the steps of folding bottom flaps of a packaging container to lay flat against exterior faces of the packaging container; shaping the packaging container so that the bottom flaps stay folded down against the exterior face of the packaging container; turning over the packaging container and closing the top of the packaging container. In one aspect, a method for assembling a packaging system can include the above steps and can further include inserting the packaging liner into the packaging container; filling the packaging liner with a product; optionally expelling air from the packaging liner; sealing the packaging liner; and closing a bottom of the packaging container.

The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

DETAILED DESCRIPTION OF EXAMPLE EMBODIMENTS

Figure 1A:
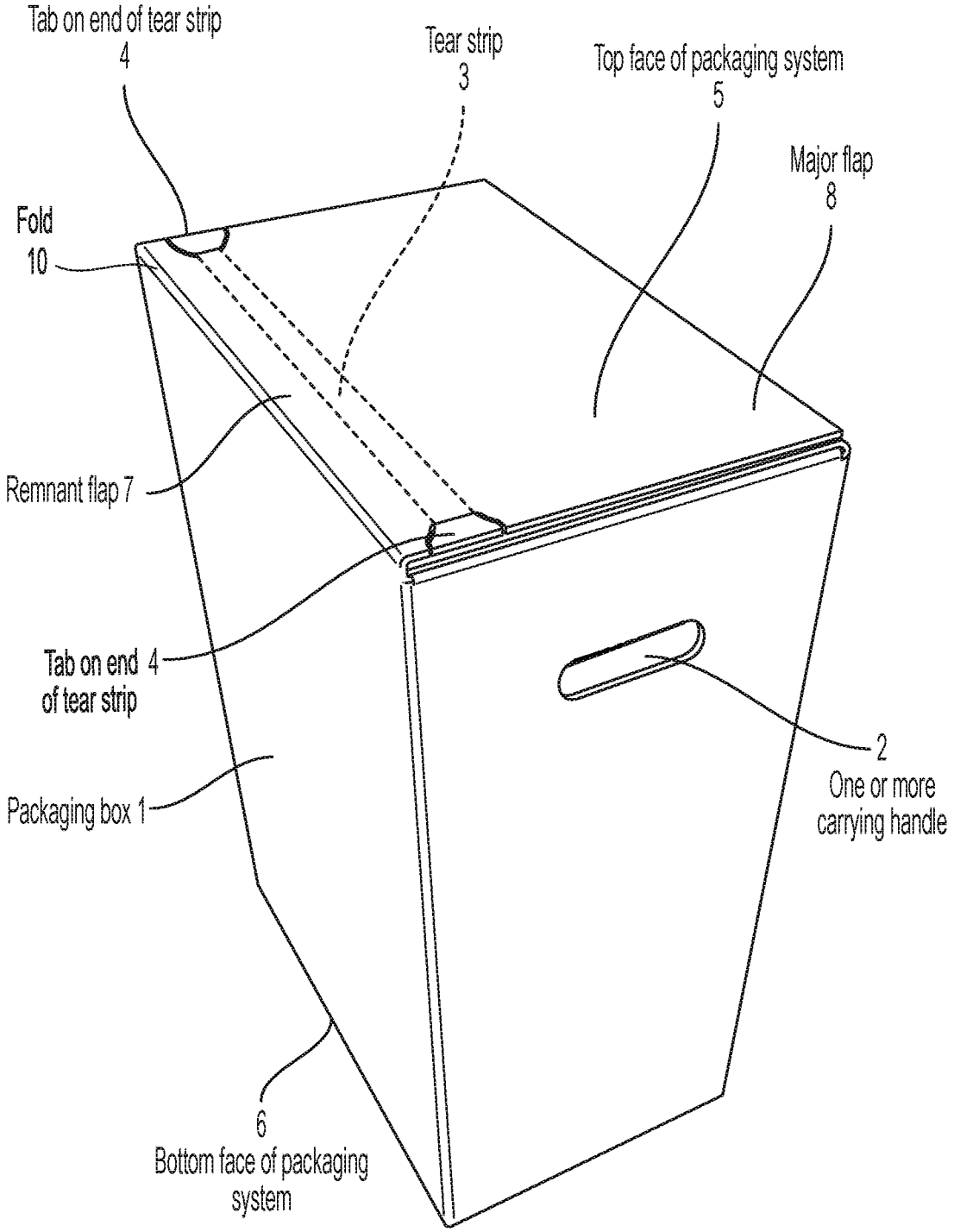
FIGS. 1A and 1B illustrate a packaging container according to an embodiment of the present disclosure.
Figure 1B:
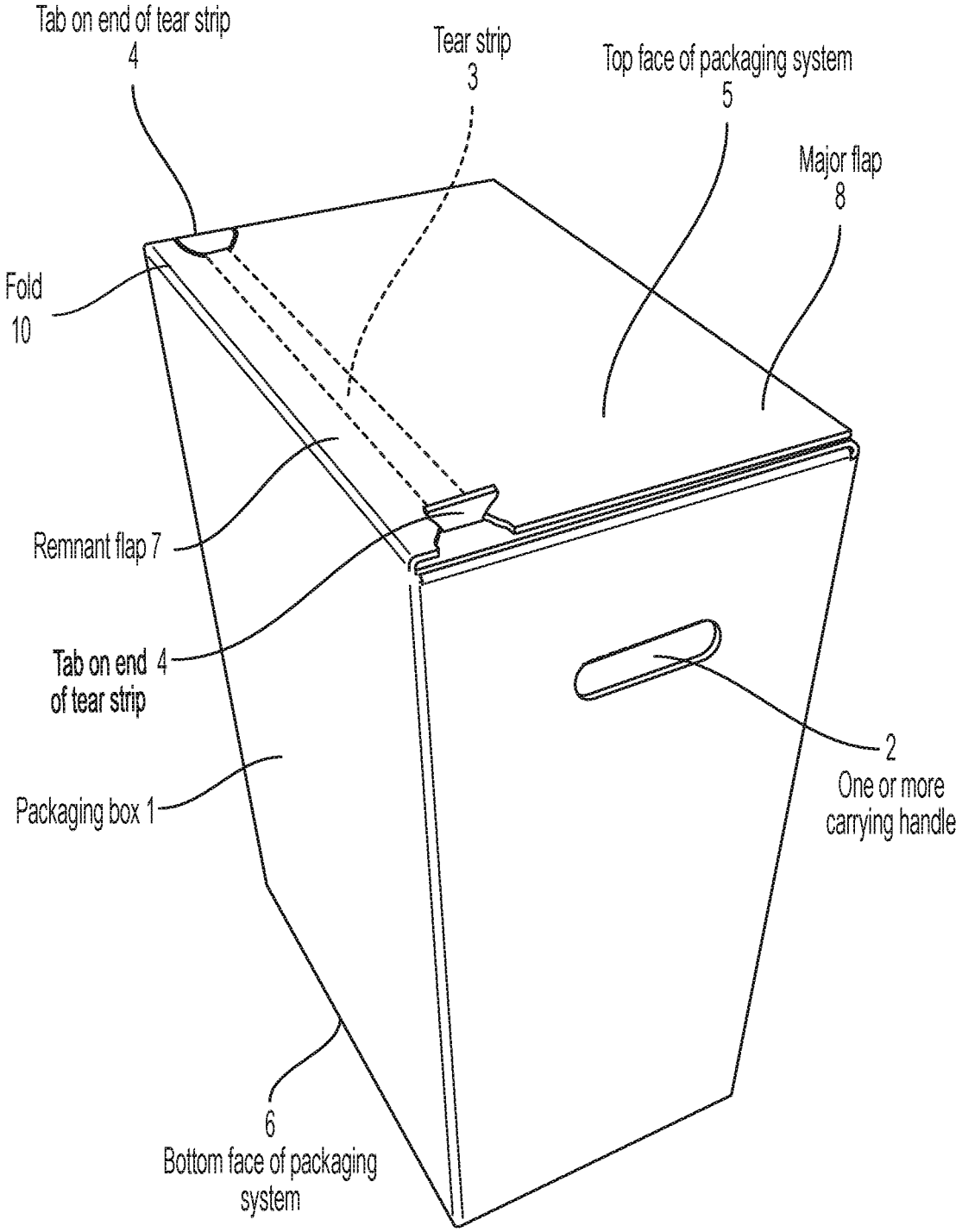

Detailed embodiments of devices and methods are disclosed herein. However, it is to be understood that the disclosed embodiments are merely exemplary of the devices and methods, which may be embodied in various forms. Therefore, specific functional details disclosed herein are not to be interpreted as limiting, but merely as a basis for the claims as a representative example for teaching one skilled in the art to variously employ the present disclosure.

It should be appreciated that various embodiments of the present disclosure can be combined with other embodiments of the disclosure and are merely illustrative of specific ways to make and use the disclosure and do not limit the scope of the disclosure when taken into consideration with the claims and the following detailed description.

As used in this disclosure and the appended claims, the singular forms "a," "an" and "the" include plural referents unless the context clearly dictates otherwise. The words "comprise," "comprises" and "comprising" are to be interpreted inclusively rather than exclusively. Likewise, the terms "include," "including" and "or" should all be construed to be inclusive, unless such a construction is clearly prohibited from the context. However, the devices disclosed herein may lack any element that is not specifically disclosed. Thus, a disclosure of an embodiment using the term "comprising" includes a disclosure of embodiments "consisting essentially of" and "consisting of" the components identified.

The term "and/or" used in the context of "X and/or Y" should be interpreted as "X," or "Y," or "X and Y." Where used herein, the terms "example" and "such as," particularly when followed by a listing of terms, are merely exemplary and illustrative and should not be deemed to be exclusive or comprehensive. Any embodiment disclosed herein can be combined with any other embodiment disclosed herein unless explicitly stated otherwise.

Ranges are used herein in shorthand to avoid listing every value within the range. Any appropriate value within the range can be selected as the upper value or lower value of the range. Moreover, the numerical ranges herein include all integers, whole or fractions, within the range.

As used herein, "about," "approximately" and "substantially" are understood to refer to numbers in a range of numerals, for example the range of −10% to +10% of the referenced number, preferably −5% to +5% of the referenced number, more preferably −1% to +1% of the referenced number, most preferably −0.1% to +0.1% of the referenced number. All numerical ranges herein should be understood to include all integers, whole or fractions, within the range. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

The methods and devices and other advances disclosed herein are not limited to particular methodologies, protocols, and reagents because, as the skilled artisan will appreciate, they may vary. Further, the terminology used herein is for the purpose of describing particular embodiments only and does not limit the scope of that which is disclosed or claimed.

Unless defined otherwise, all technical and scientific terms, terms of art, and acronyms used herein have the meanings commonly understood by one of ordinary skill in the art in the field(s) of the present disclosure or in the field(s) where the term is used. Although any compositions, methods, articles of manufacture, or other means or materials similar or equivalent to those described herein can be used, specific devices, methods, articles of manufacture, or other means or materials are described herein.

Furthermore, in the following description, it should be understood that terms used to express geometric or other such relations (e.g. "parallel") between components are considered as being substantive terms rather than exact ones, and that as a result the qualifier "substantially" to be read into any such term unless stated otherwise.

The invention is further described with reference to the following examples. It will be appreciated that the invention as described is not intended to be limited in any way by these examples. The preferred embodiments relate to packaging containers, systems, devices and methods relating thereto.

In an embodiment, a packaging container or system is provided that does not require tools (e.g., a scissor, a packaging container cutter, a knife, etc.) to open the packaging container or system to access a product within the packaging container or system. The packaging container or system may be configured to be placed in an upright vertical package orientation. The upright vertical package orientation can be configured to display the packaging container or system on a smallest side of the packaging container and/or be carried in a vertical upright position. The upright vertical package orientation is more ergonomic for a consumer than traditional packaging systems and allows a consumer to reach down and pick up the packaging container or system without squatting to the floor. In an embodiment, a packaging container or system is configured to breakdown and/or flatten without tools and/or requiring traditional container breakdown and/or flattening methods.

In an embodiment, the packaging system includes a packaging container. The packaging container can be made of a corrugated fiberboard or paper board. In a non-limiting embodiment, the packaging container may be in the form of a full overlap slotted container ("FOL"). In such an embodiment, the packaging container may include one or more flaps. In one aspect, the packaging container can include pairs of flaps, wherein the pairs of flaps can be the same length. In one an embodiment, the flap length can equal approximately the width of the container. In particular, when an FOL is closed, the outer flaps may come within approximately one inch of a complete overlap. An FOL has the advantage of being resistant to rough handling. In one aspect, the packaging container can have two pairs of bottom flaps and two pairs of top flaps, each pair having an outer flap and an inner flap when assembled. Such pairs can include a major pair and a minor pair, wherein the major pair is greater in area than the minor pair. Such pairs can also be equal length and width. In one aspect, the bottom major and minor pairs can overlap when folded in a closed configuration. In another aspect, the top major pair can overlap and the top minor pair does not overlap when folded in a closed configuration. Generally, the top major pair can substantially overlap, and in some aspects, completely overlap such that the flaps can be bonded and provide structural integrity to the container during shipping.

In a non-limiting embodiment, the packaging container may be in the form of a regular slotted container ("RSC"). In such an embodiment, the two outer flaps of the packaging container meet at the center of the packaging container when folded.

In an embodiment, the packaging container is die cut and glued at the joints. In an embodiment, the packaging container includes at least one major and at least one minor flap. The at least one major and the at least one minor flaps can be attached together. In an embodiment, the dimensions of the packaging container can be 15 1/16" L×8 13/16" W×22 1/4" D.

In an embodiment, the packaging container can have an inner coating that protects and preserves the product contained in the packaging container. The inner coating can keep the product fresh and/or prevent grease staining of the packaging container. The inner coating can be applied to the inside of the packaging container via lamination of a plastic film (i.e., laminate, coextrusion or mono layer), a coated paper by gluing, extrusion lamination or hot melt to the inside of the corrugate material. In an embodiment, the coating can or be applied by coating directly to the corrugated inner liner via extrusion, flexo, curtain coating, rod coating, size press or any manner or means of applying coatings on paper. The coating may also be applied to the inside of the erected container using spraying.

In an embodiment, the cut edges of the corrugated material can be treated with a coating as well to prevent wicking of the fat around the coated inner paper layer of the container. The ends of the packaging container may also be glued to make a sift proof seal to prevent product fines, grease and fat from leaking out of the container. The coating may be heat sealable to make the container ends sealed to prevent product fines, grease and fat from leaking out of the container. In an embodiment, the inner coating replaces the packaging system liner.

In an embodiment, the packaging container or system is configured to be recycled. For example, the packaging container or system may be produced from 100% recyclable material. In an embodiment, the packaging container or system may be 100% recyclable. In an embodiment, the packaging container or system is curbside recyclable. The packaging container or system may be drop off recyclable.

In an embodiment, a variable fill packaging system is provided. In a variable fill packaging system, a packaging system of a selected size can hold various products including various product densities inside the packaging system. In a variable fill packaging system, a packaging liner can hold various products including various product densities inside the packaging system. Such an embodiment may eliminate a need for stock keeping unit ("SKU") specific bag sizes (e.g., when a selected product requires a first bag size, and a second product requires a different, second bag size).

In an embodiment, a packaging container or system may hold cans. For example, a packaging container or system may be sized to hold multiple cans of wet pet food. In an embodiment, a packaging system liner holds a first product in the packaging system, and the packaging system additionally holds a second product in the packaging system that is not held within the packaging liner. In an embodiment, a packaging container or system holds a product, and the packaging system may not include a packaging liner.

In an embodiment, a packaging container or system includes carrying handles. Such carrying handles can be formed by perforating either or both sides of the box in a circular, oval, elliptical, or other geometry such that fingers of a hand can be placed through the side to lift the packaging container. In another embodiment, the carrying handles can be formed by removal of a portion of the side (e.g. die cutting) in a circular, oval, elliptical, or other geometry such that fingers of a hand can be placed through the side to lift the packaging container. Generally, the carrying handles can be positioned in a location on the packaging container or system to be effective for carrying the packaging container or system and pouring product from the packaging container or system in a vertical package orientation. In an embodiment, the carrying handles and vertical package orientation allows a consumer to carry the packaging container or system closer to the body of the consumer (e.g., in a more ergonomic manner compared to a horizontal orientation, especially when the packaging container or system is heavy for the consumer). The carrying handles can be positioned up to about ⅓ of the way down from a top of the packaging container or system on respective sides of the packaging container or system. In an embodiment, the carrying handles can be located approximately 6" from the top of the packaging container or system. In another embodiment, the carrying handles can be located approximately 4" from the top of the packaging container or system. In an embodiment, an additional or alterative handle or handles is positioned about 3 inches from a bottom of the packaging container or system for use by the consumer to hold a base of the packaging container or system while a consumer pours product from within the packaging container or system.

In an embodiment, a packaging container or system includes a tear strip comprising a tear tape and/or a perforated strip on a top face of the packaging container or system configured to provide an easy to use, tool-free packaging container or system opening experience. The location of the tear strip on the top of the packaging container or system is an obvious visual location for a consumer in an embodiment when the packaging container or system is oriented in a vertical upright position. In an embodiment, the tear strip of a packaging container or system can include a tab on one or each respective end of the tear strip, the tab configured to provide a finger hold for pulling back the tear strip. Generally, the tear strip can be located on the outer flap of the top or bottom major pair positioned opposite of the hinge point of the outer flap such that the majority of the surface area of the inner side of the outer flap can be used to bond with the inner flap. As such, in one aspect, the tear strip can be located on the outer half of the flap; i.e., distanced by at least 50% of the width from the hinge point of the flap. In other aspects, the tear strip can be distanced by at least 60%, at least 70%, at least 80%, and even at least 90% of the width from the hinge point of the flap. The further the tear strip is distanced from the hinge point, the greater the available surface area of the inside of the flap can be bonded to the inner flap, while still allowing easy break down of the container after use without the need of tools or other physically intensive efforts as discussed herein.

In an embodiment, a packaging container includes a tear off flap. Such tear off flaps can be substituted for any flaps disclosed herein. In an embodiment, a packaging container includes two smaller flaps on a top of the packaging system and/or a large closure flap a top of the packaging system. The tear off flaps can be perforated for a consumer to easily remove the tear off flaps from the packaging container, for example to allow the consumer to pour a product from the packaging container or system. As such, in various embodiments, the top, bottom, minor and/or major flaps can be perforated. Such an embodiment may create an obstruction-free pour experience. In an embodiment, the tear off flaps may be the same or different lengths and can be long (to enable more packaging container or system compression strength) or short (to enable a consumer to more easily pour product from the packaging container or system). For example, the tear off flap may be substantially the width of the packaging container. Alternatively, the tear off flaps may be less than half the width of the packaging container.

In an embodiment, a bottom tear strip is provided on a bottom of the packaging container. In such an embodiment, the bottom tear strip, when removed, configures the packaging container for flattening for recycling. When the packaging container includes both a top tear strip and a bottom tear strip, an average-strength consumer is able to effectively flatten the packaging container for disposal.

In an embodiment, a packaging system is provided herein which utilizes a packaging liner which is positioned in a packaging container. The packaging liner may be a hermetically sealed packaging liner. In such an embodiment, the packaging liner is sealed to ensure freshness of the product within the packaging liner. The packaging liner may include a top seal, the top seal being a straight across, U-shape and/or an angle "/" or "\". In an embodiment, a top portion of the packaging liner includes a tear notch. In such an embodiment, the tear notch can be about 4 to 6 inches from a top corner of the packaging liner. The tear notch may be configured to allow a consumer to remove the top corner of the packaging liner to allow a user to pour product from within the packaging liner. In an embodiment, the tear notch and a pour spout position on the packaging system aid a consumer in pouring product from the packaging system into a storage container.

In an embodiment, the packaging liner is long enough to allow it to be cuffed over an end flap of the packaging container. The packaging liner can be manufactured from plastic. In an embodiment, the packaging liner is clear to aid a consumer in observing and directing a flow of product when pouring the product from the packaging system into another storage container and/or to aid a consumer in observing a level of product within the packaging system. The packaging liner may be manufactured from a stiff material that can be folded over so a consumer is able to roll down a top portion of the packaging liner for storage of the product within the packaging system. The packaging liner can be a heat sealable material, including coated materials, polyethylene, ethyl vinyl alcohol, etc., and can be sealed by multiple methods. In a non-limiting embodiment, the packaging liner can be sealed with the use of reformed side gussets. The packaging liner may alternatively be pulled flat with no side gussets. In an embodiment, the headspace air in the packaging liner is expelled before sealing to allow the packaging system to be closed. The packaging liner can be hand sealed with the use of, for example, an impulse sealer or a Teflon covered hot bag type sealer. In an embodiment, the packaging liner can be sealed with automated sealing methods such as a band sealer by pulling the packaging liner flat or after reforming the gussets and conveying the packaging container underneath the sealer. In an embodiment, the packaging liner bottom is already sealed and the packaging liner top is hermetically sealed after it is placed in the packaging container and filled with the product. In an embodiment, the packaging liner is manufactured from heat sealable 100% recyclable coated paper. In such an embodiment, the packaging liner may be recycled in a paper recycling stream.

In an embodiment, the packaging liner is integrated within the packaging system. The packaging liner can be attached to the inside of the packaging container. In such an embodiment, when the packaging container is assembled and erected the packaging liner is sealed on one end, the product is filled into the packaging liner and then the remaining open end of the packaging liner is sealed shut and the open end of the packaging container is closed. Alternately, the packaging liner can be filled with product and sealed prior to insertion into the packaging container.

In an embodiment, an exterior surface of the packaging container is branded (i.e., includes images and/or trademarks associated with the product). In an embodiment, the packaging container exterior surface is digitally printed. For example, a packaging container is provided using in-line digital printing. In such an embodiment, the digitally printed exterior surface allows for store-specific SKU's to be printed on the packaging container, customizable and/or complex graphics to be printed on the exterior surface, personalized graphics to be printed on the exterior surface, label and/or graphics to be easily changed and/or updated when a new or revised exterior surface is required, and/or promotional material to be added to the exterior surface of the packaging container. A selected packaging container or system may be personalized by a user to include information on the packaging system such as a consumer pet name, messaging, user selected ingredients, feeding instructions, etc. In an embodiment, the printed graphics can be replicated on both major faces of the packaging container or system. In such an embodiment, the information may not be covered up by a shipping label.

In an embodiment, the packaging liner is unbranded (i.e., does not include images and/or trademarks associated with the product) or branded with a repeating pattern. In an embodiment, the packaging liner is transparent. In an embodiment, the packaging system and packaging liner are filled and sealed at the manufacturer's location, and do not require additional packaging at, for example, a third party e-commerce sales and/or shipping location.

In an embodiment, the packaging liner, when integrated into the packaging system, allows the packaging system liner to be filled at a fill level corresponding to a specification for a specific product, but does not change the size of the overall packaging system. Such a configuration allows for less variability in shipping and/or display dimensions of the product than traditional packaging systems, while still allowing for variable product fill amounts within the packaging system.

FIGS. 1-6 generally illustrate a packaging container. Specifically referring to FIG. 1A, the packaging container is designed to stand and be displayed on its smallest side and to be carried in a vertical upright position. The packaging container (1) may include; one more carrying handles (2); a tear strip (3); and one or more tabs on the tear strip (4). In FIG. 1A the tab (4) is shown laying flat against the surface of the packaging container. In FIG. 1B the tab (4) is shown pointing up. The one or more carrying handles can be positioned in a location on the packaging container to be effective for carrying the packaging container and pouring the product from the packaging container in a vertical package orientation. In particular, the one or more carrying handles and the vertical orientation of the packaging container allows consumers to carry the packaging container closer to the body of the consumer (e.g., in a more ergonomic manner compared to a horizontal orientation, especially when the packaging container is heavy for the consumer). The location of the one or more carrying handles (2) can be up to about ⅓ of the way down from a top face (5) of the packaging system on respective sides of the packaging container. Alternatively, the location of the one or more carrying handles (2) is about 6" from the top of the packaging container or about 4" from the top of the packaging container. Optionally, a second set of one or more carrying handles (2') can be up to about ⅓ of the way up from a bottom face (6) of the packaging container. In one aspect, the second set of handles can be positioned about 3 inches from the bottom face (6) of the packaging container for use by the consumer to hold a base of the packaging container while a consumer pours product from within the packaging container. The tear strip (3) can be located on the top face (5) of the packaging container and is configured to provide an easy to use, tool-free packaging container opening experience. For example, the location of the tear strip (3) on the top of the packaging container is an obvious visual location for a consumer when the packaging container is oriented in a vertical upright position. The tear strip may include a tear tape and/or perforated strip. The tear strip can further include a small tab (4) on either or both ends of the tear strip. The small tab is configured to provide a finger hold for pulling back the perforated strip. The top of the face of the packaging container further includes at least one minor flap (not shown), a remnant flap (7) (formed after removal of the tear strip) and at least one major flap (8). The tear strip (3) may be located between the middle of the major flap (8) and the fold (10) of the major flap (8).

Figure 2:
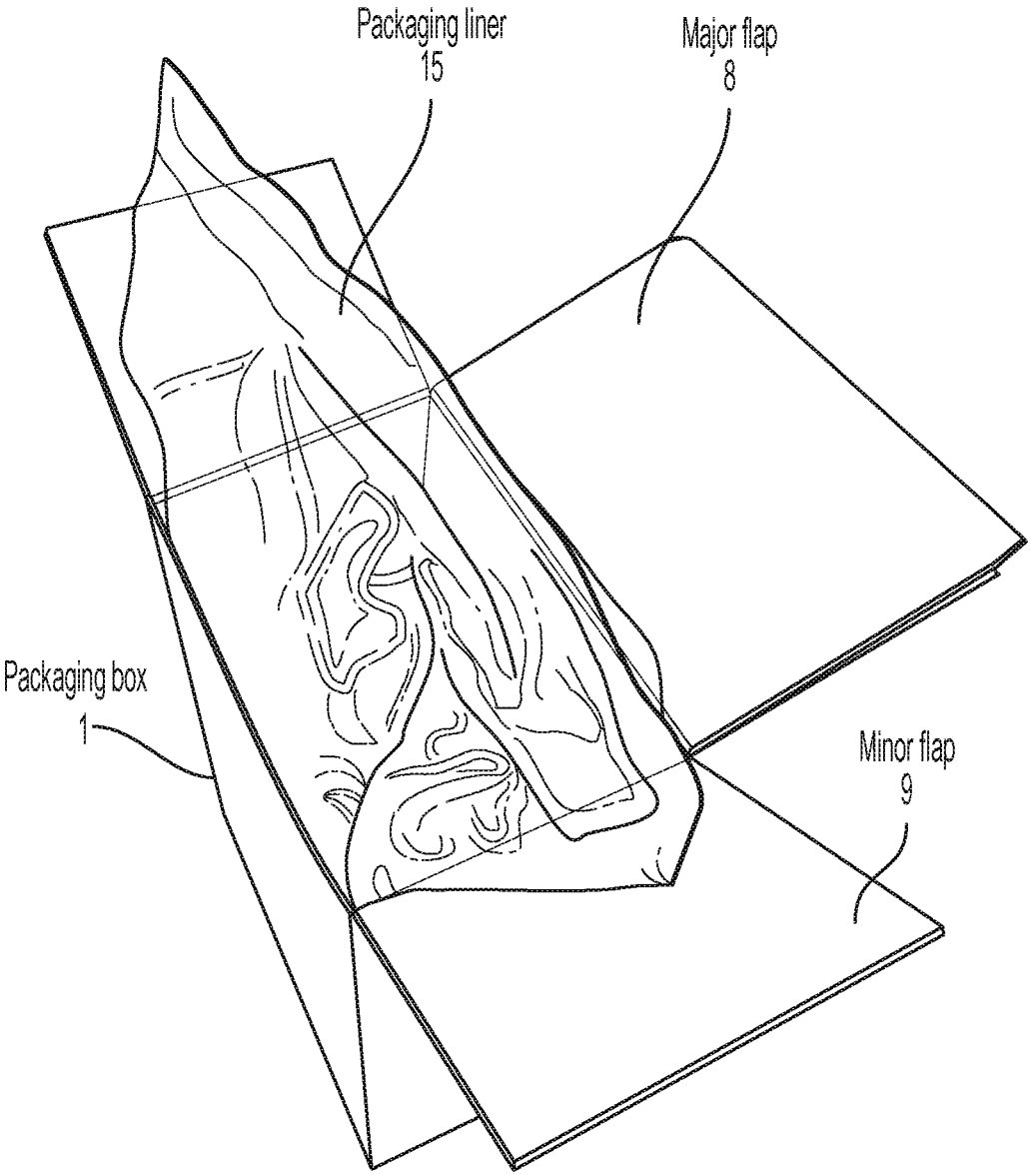
FIG. 2 illustrates a packaging system according to an embodiment of the present disclosure with the packaging system open and the packaging liner shown.

FIG. 2 illustrates the packaging system including the packaging liner. In an embodiment, the packaging liner (15) is inserted into the packaging container (1) with a minor flap (9). FIG. 2 shows an embodiment where the tear strip is located at the edge of the major flap (8) such that no remnant flap (7) is present upon removal of the tear strip. As shown in FIG. 2, the packaging liner is long enough to allow it to be cuffed over an end flap of the packaging container. In an embodiment, the packaging liner is configured to retain a particulate material. For example, a particulate material may include pet food, pet litter, sand, and/or other materials. For example, the particulate material may weigh about 20 to about 60 pounds. In a preferred embodiment, the particulate material may weigh about 27 to about 38 pounds. In a preferred embodiment, the particulate material is a dry product. The packaging liner may protect the packaging system from grease staining (i.e., leakage onto the packaging system exterior).

Figure 3:
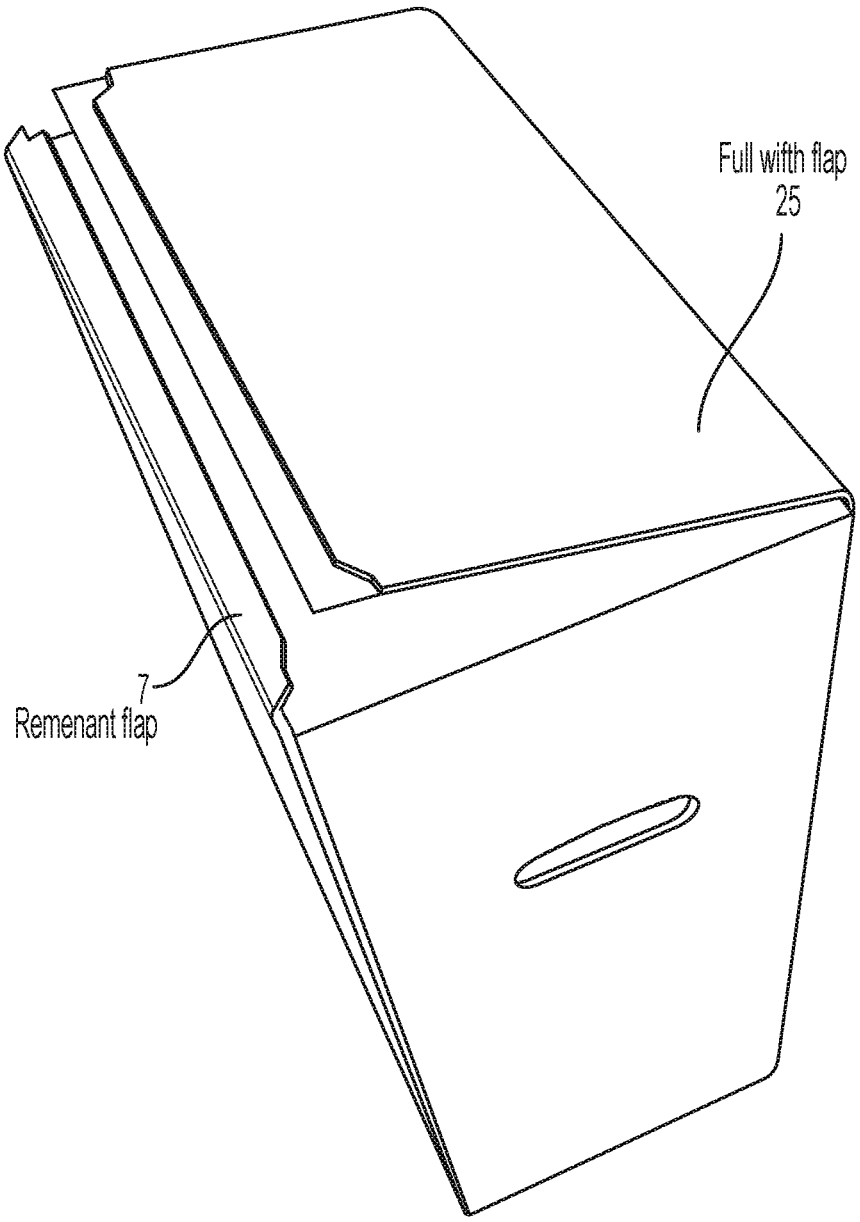
FIG. 3 illustrates a packaging container according to an embodiment of the present disclosure.

FIG. 3 illustrates an additional or alternative view of the packaging container. In an embodiment, when the tear strip (3) is removed by a consumer a full-width flap (25) forms configured to fold away from the remaining portion of the packaging container, therefore allowing the consumer to easily dispense the product by pouring or scooping the product from within the packaging container or system (when container includes a liner). In such an embodiment, the remnant flap (7) forms upon removal of the tear strip and is configured to partially enclose the full-width flap, therefore restraining the full-width flap from rising. As such, if the consumer chooses to store an opened (i.e., unsealed) product in the packaging container or system, the hinged lid is configured to be positioned underneath a remnant flap to prevent the lid from easily and/or accidentally being flipped up.

Figure 4:
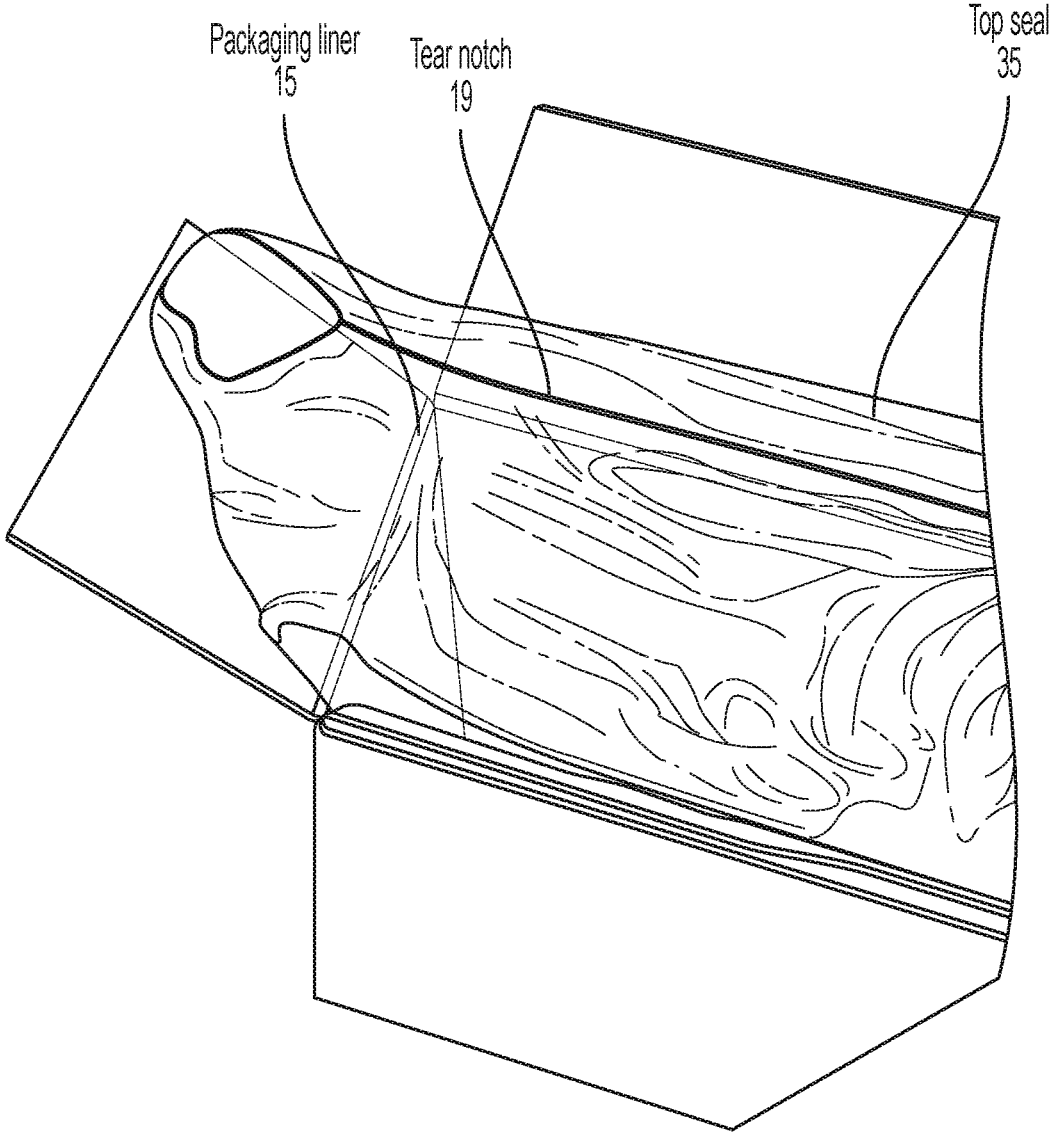
FIG. 4 illustrates a packaging system according to an embodiment of the present disclosure with the packaging system open and the packaging liner shown.

FIG. 4 illustrates an alternative view of an embodiment of the packaging system with the packaging liner. The packaging liner (15) includes a top seal (35), the top seal being a straight across, "U" shape and/or an angle "/" or "\". In an embodiment, a top portion of the packaging liner includes a tear notch (19). The tear notch may be about 4 to 6 inches from a top corner of the packaging liner. The tear notch may be configured to allow a consumer to remove the top corner of the packaging liner to allow a user to pour product from within the packaging liner.

Figure 5:
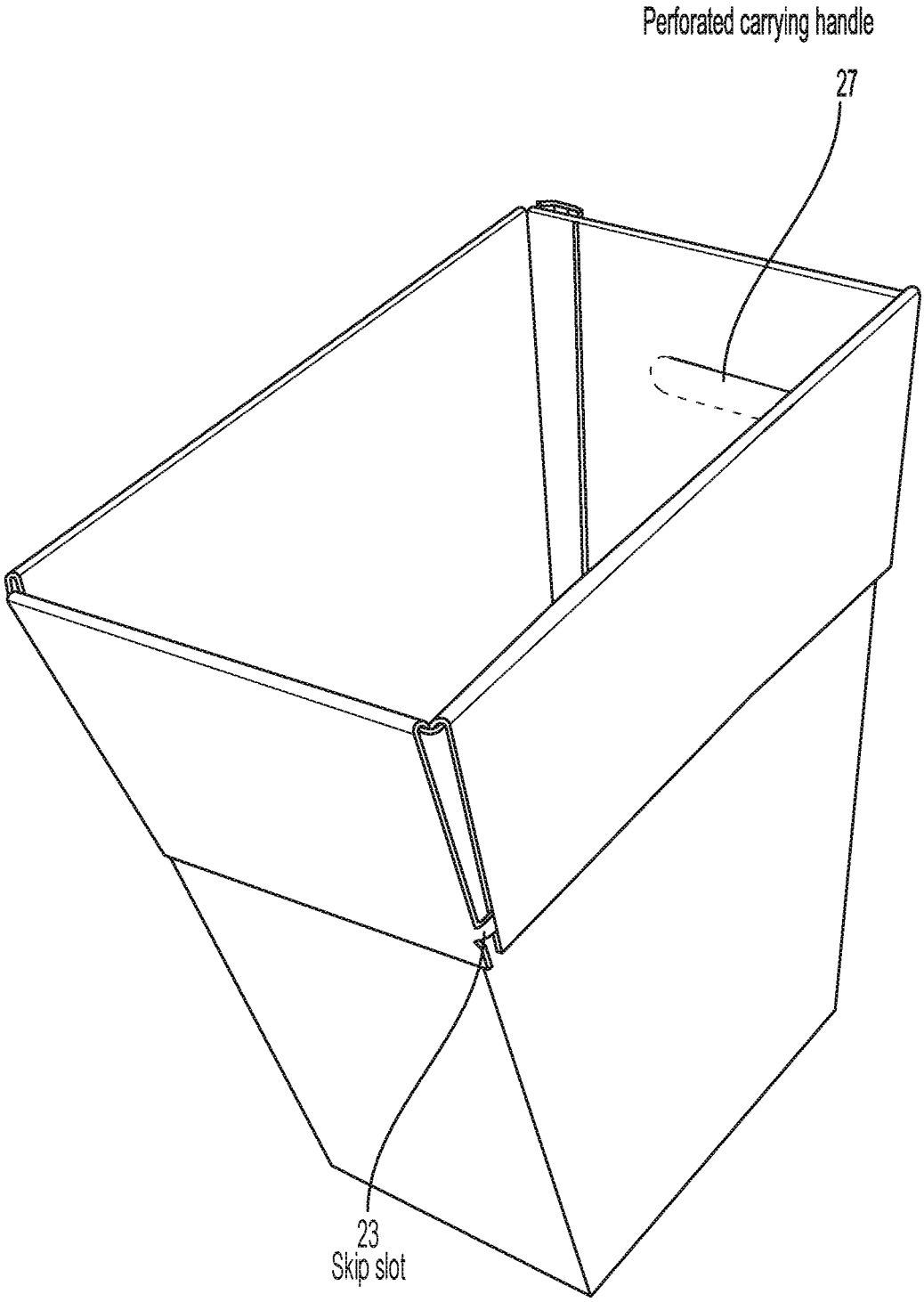
FIG. 5 illustrates a packaging container according to an embodiment of the present disclosure.
Figure 6:
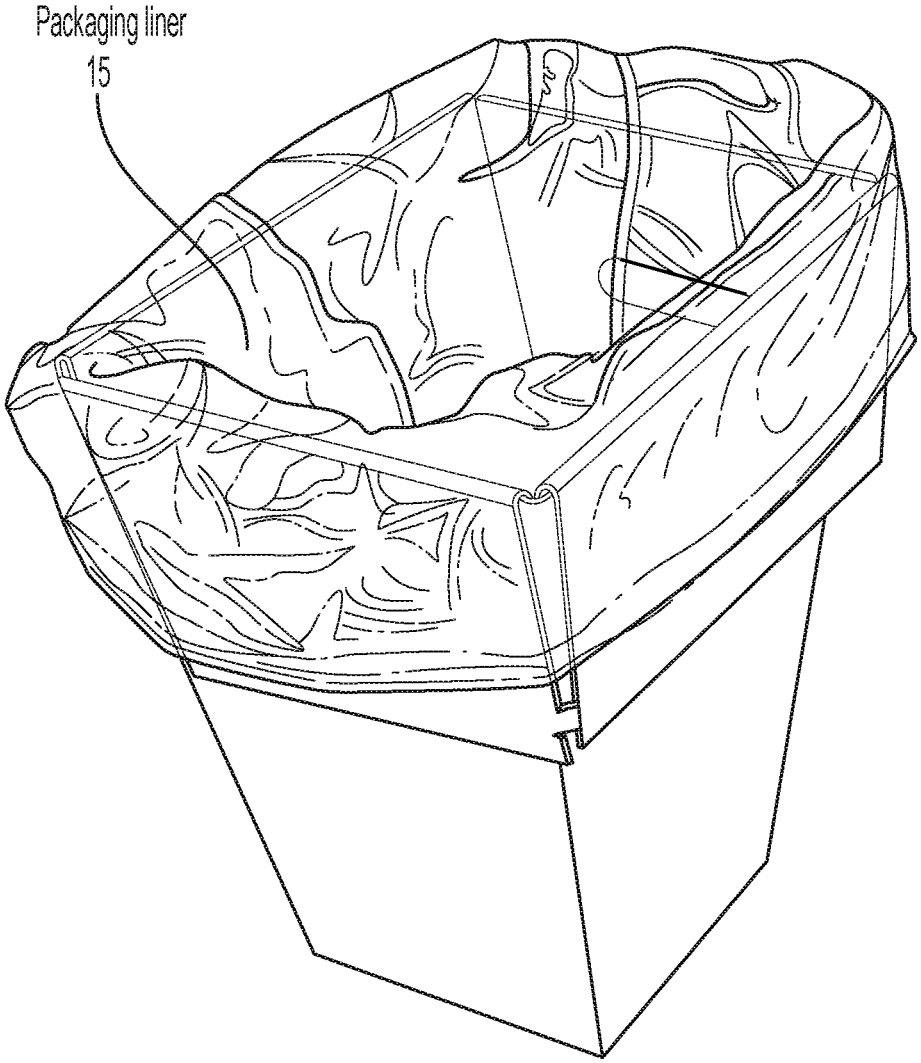
FIG. 6 illustrates a packaging system according to an embodiment of the present disclosure with the packaging system open and the packaging liner shown.

FIG. 5 illustrates the packaging container using skip slots (23). As shown in FIG. 6, the flaps of the packaging container include skip slots (23) to hold the flaps in place when the packaging container is in the open position. FIG. 5 further illustrates an embodiment where the handles are formed by perforating such that fingers of a hand can be placed through the side to lift the packaging container and a portion of the container material may remain attached (27).

FIG. 6 illustrates a packaging system including a packaging liner. The packaging liner (15) is long enough to allow it to be cuffed over an end flap of the packaging container. In an alternate embodiment, the packaging liner is not cuffed over the end flap.

Figure 7:
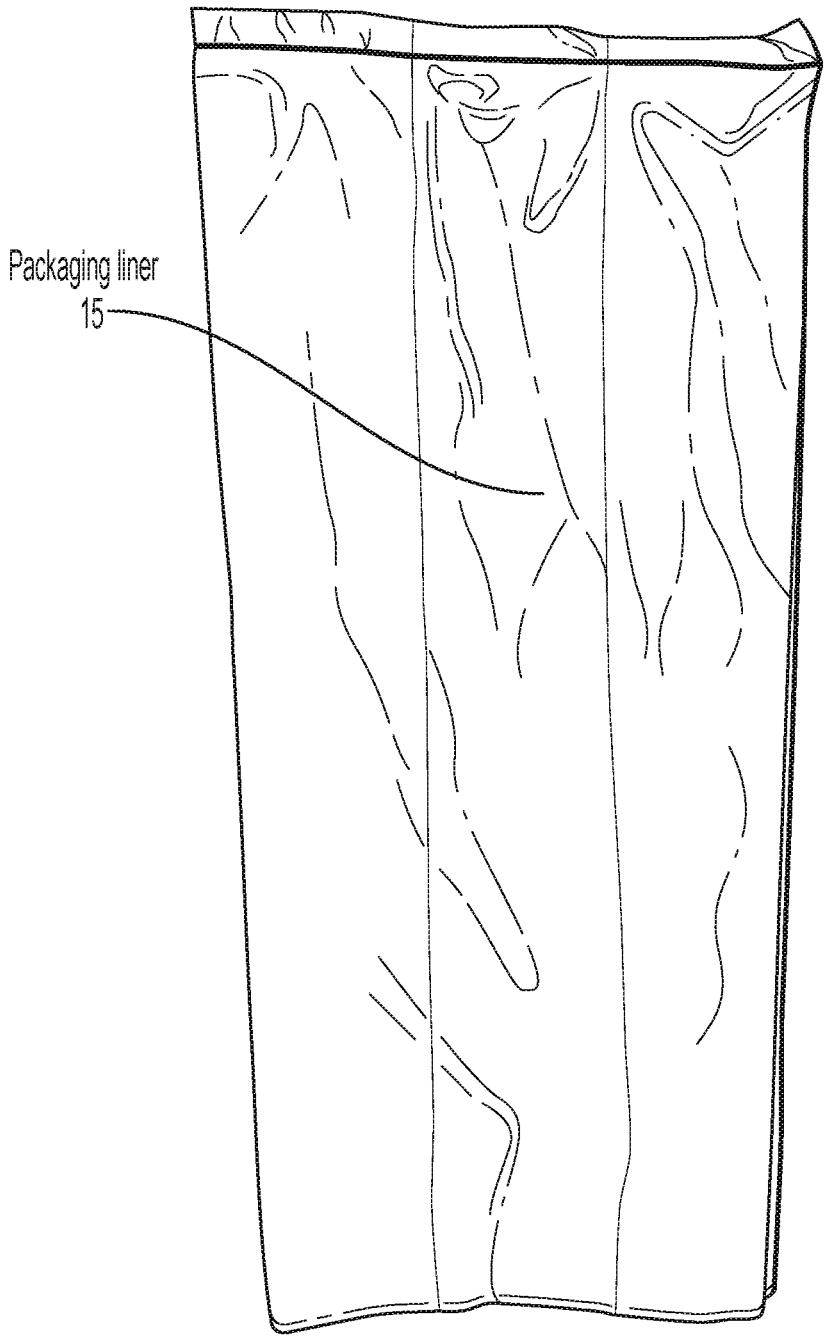
FIG. 7 illustrates a packaging liner.

FIG. 7 illustrates a packaging liner according to an embodiment of the packaging system. The packaging liner (15) may seal odors from the product within the packaging liner, and substantially restrict such odors from reaching the consumer. As shown in FIG. 7, the packaging liner may be clear to aid a consumer in observing and directing a flow of product when pouring the product from the packaging system into another storage container and/or to aid a consumer in observing a level of product within the packaging system. The packaging liner bottom may already be sealed and the packaging liner top may be hermetically sealed after it is placed in the packaging container and filled with the product.

Figure 8:
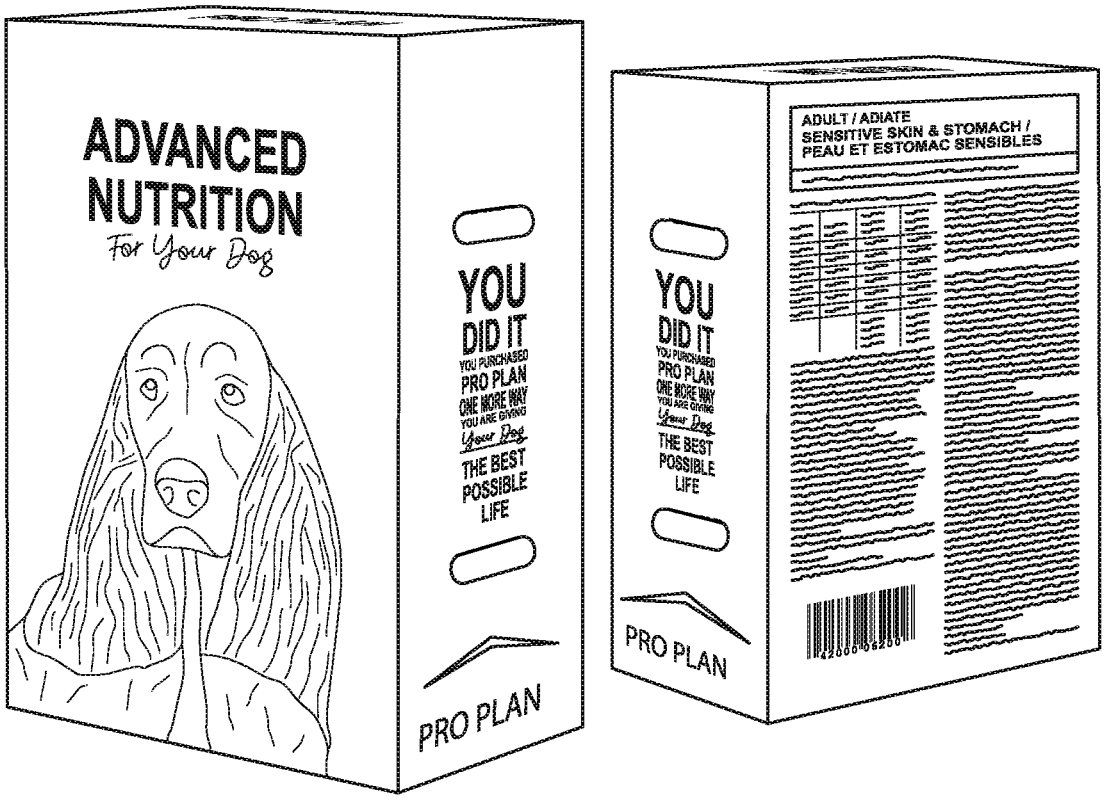
FIG. 8 illustrates a packaging container according to an embodiment of the present disclosure.

FIG. 8 illustrates an embodiment of the packaging container including a branded packaging container. As shown in FIG. 8, an exterior surface of the packaging container may include a digitally printed exterior surface to allow for store-specific SKU's to be printed on the packaging container, customizable and/or complex graphics to be printed on the exterior surface, personalized graphics to be printed on the exterior surface, label and/or graphics to be easily changed and/or updated when a new or revised exterior surface is required, and/or promotional material to be added to the exterior surface of the packaging container.

Figure 9:
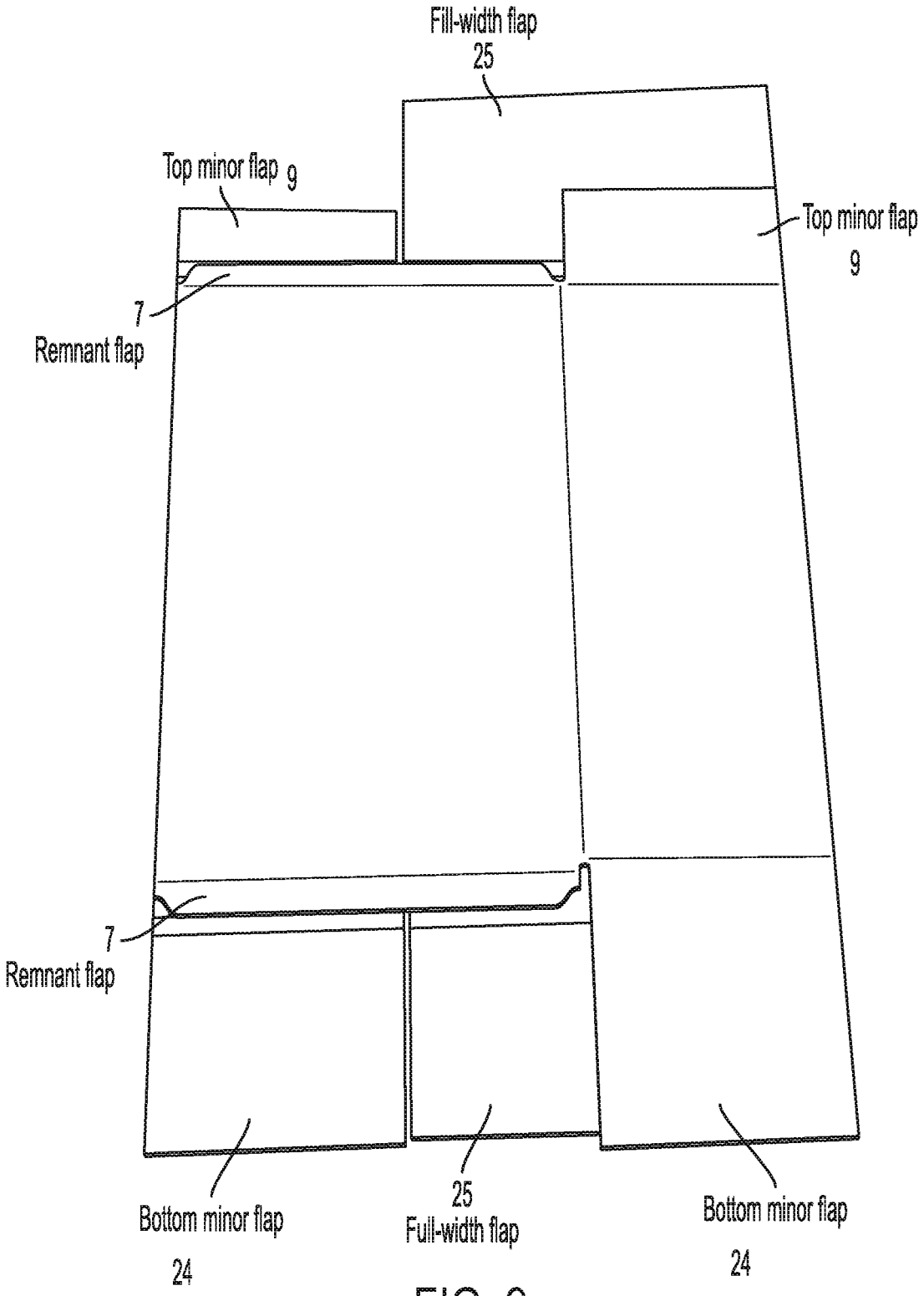
FIG. 9 illustrates a flattened packaging container according to an embodiment of the present disclosure.
Figure 10:
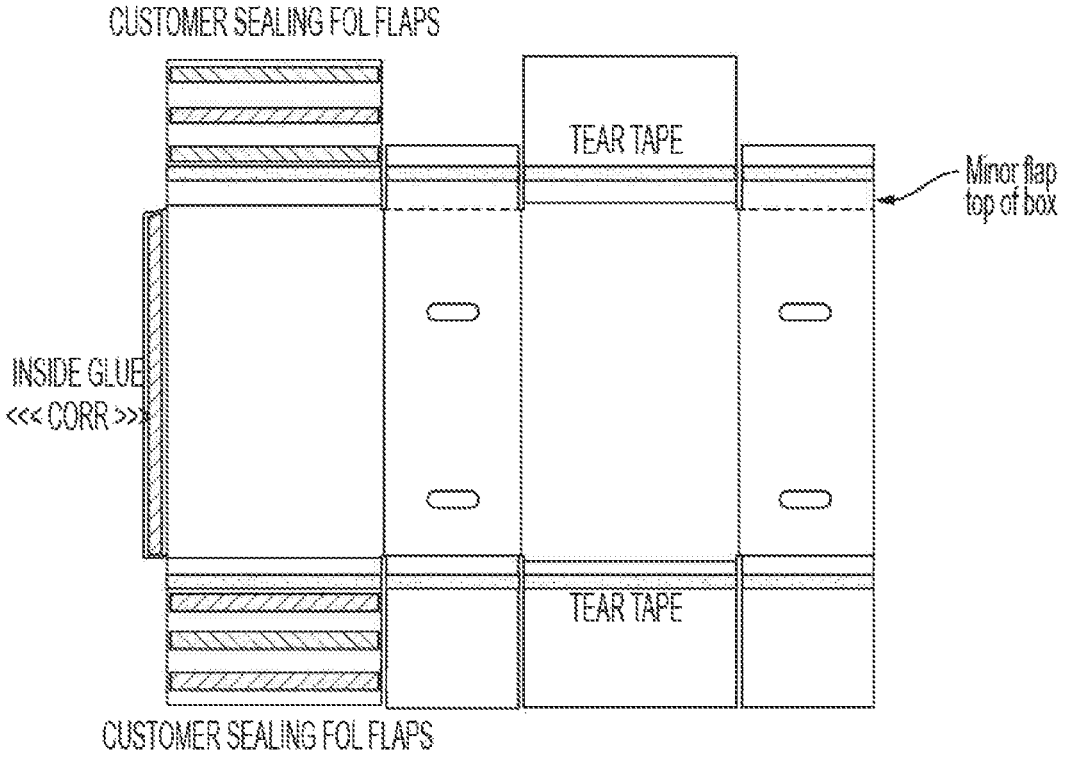
FIG. 10 illustrates a flattened packaging container ready for assembly according to an embodiment of the present disclosure.

FIG. 9 illustrates a flattened packaging container having two remnant flaps (7), top minor flaps (9), bottom minor flaps (24), and two full-width flaps (25). FIG. 10 illustrates a packaging container prior to assembly according to embodiments of the present disclosure. As shown in FIG. 10, the container can include two pairs of flaps on the top and the bottom of the container, where each set of flaps are of equal length. Such an embodiment allows for both pairs of bottom flaps to overlap while only the major pair on the top overlap. Such an embodiment allows for easier access to the contents from the top as the minor flaps are shorter in length. Once the bottom tear strip and the top tear strip are removed, the container can be flattened for recycling.

Figure 11:
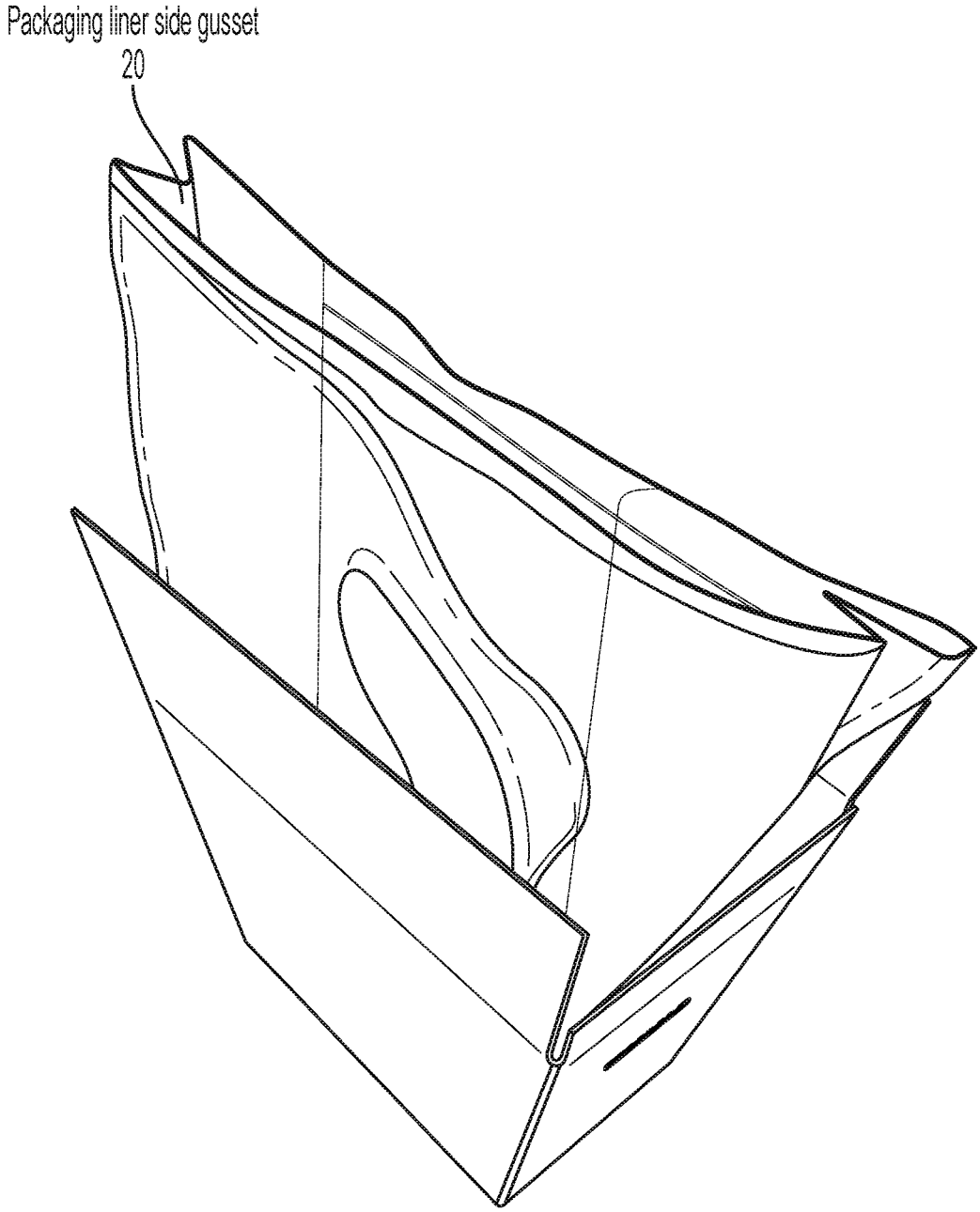
FIG. 11 illustrates a packaging liner in a packaging container with reformed side gussets.
Figure 12:
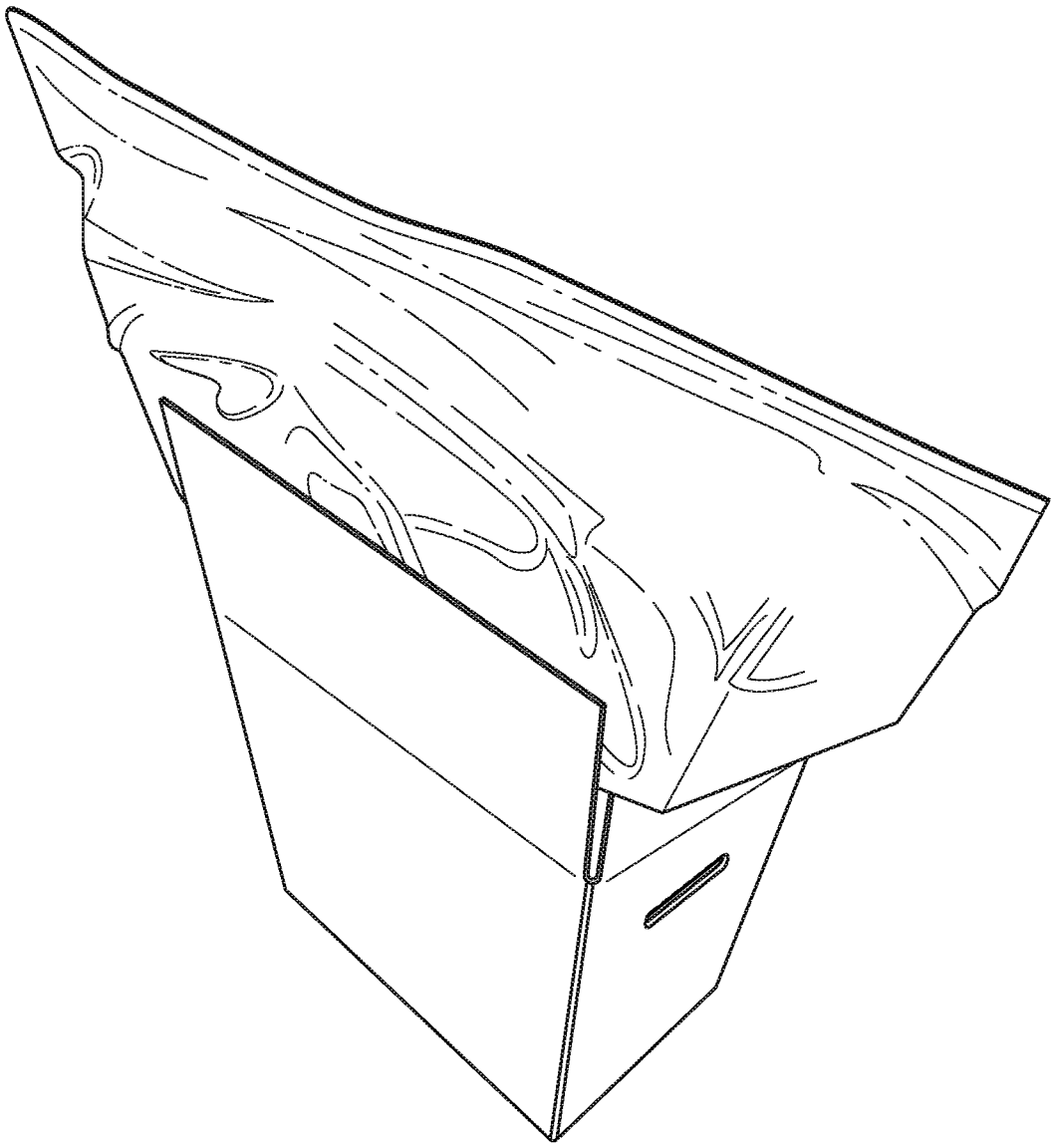
FIG. 12 illustrates a packaging liner in a packaging container without reformed side gussets.
Figure 13A:
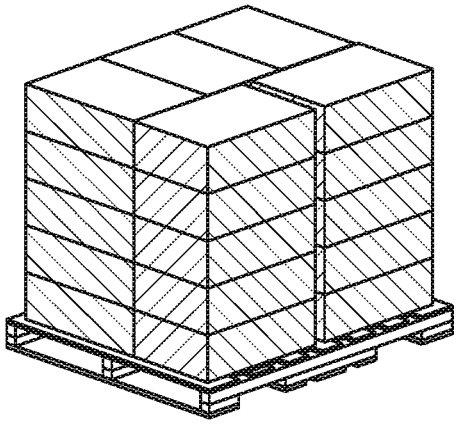
FIGS. 13A-D illustrate a pallet system for stacking the packaging system according to an embodiment of the present disclosure.
Figure 13B:
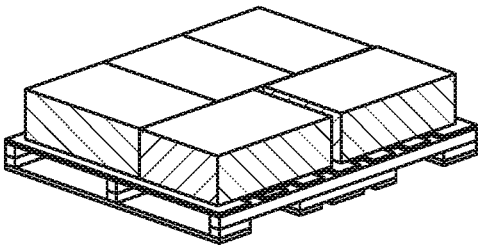
Figure 13C:
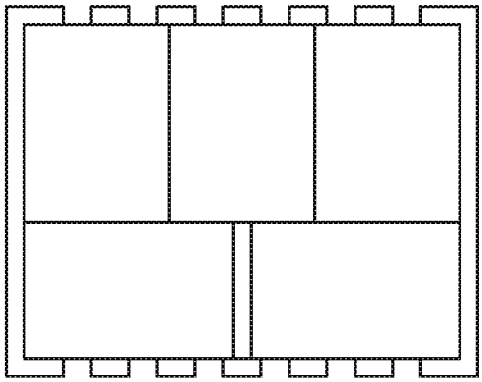
Figure 13D:
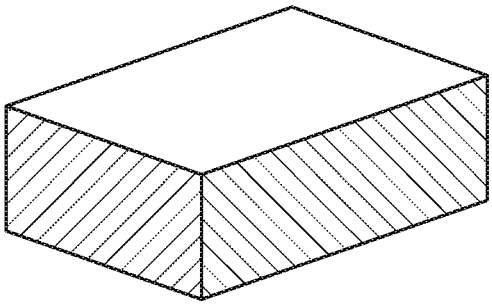

FIGS. 11 and 12 show a packaging liner. In FIG. 11, the packaging liner includes a side gusset (20). In FIG. 12, the packaging liner does not include the side gusset.

FIGS. 13A-D illustrate a pallet system for stacking the packaging containers or systems according to an embodiment of the present disclosure. As shown, the filled packaging containers are laid flat and stacked with five packaging containers per layer and five layers.

Figure 14:
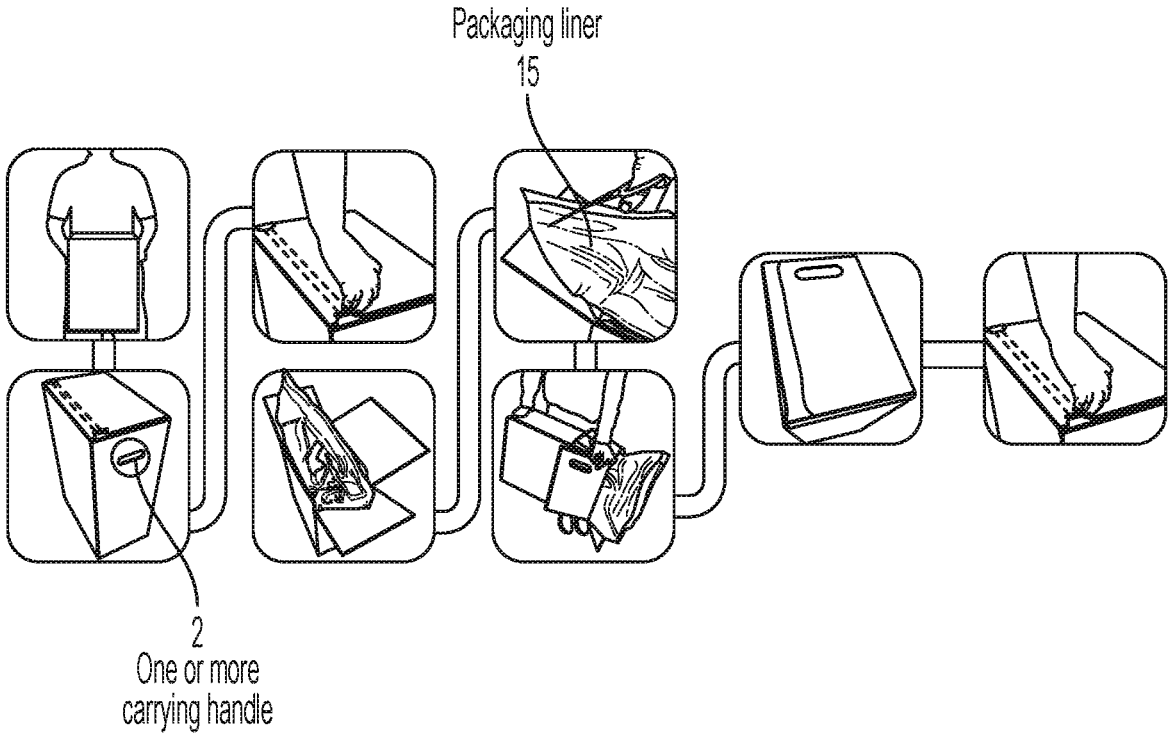
FIG. 14 illustrates a flow chart for utilizing a packaging system according to the present disclosure.

FIG. 14 illustrates a flow chart of a consumer utilizing the packaging system. The consumer carries the packaging system close to the consumer utilizing the carrying handles (2). The consumer uses the tabs (4) on the end of the perforated strip to open the packaging system. The consumer opens the packaging liner (15) and pours the product. The consumer then closes the packaging system by placing the full-width flap underneath the remnant flap. Once the packaging system is no longer needed, the consumer then removes the bottom tab allowing the packaging system to be flattened for disposal.

Figure 15:
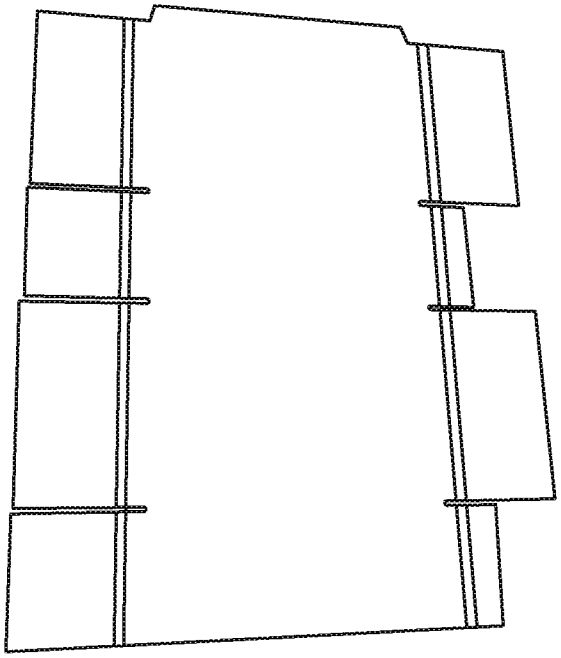
FIG. 15 illustrates a wrap-around packaging container according to an embodiment of the present disclosure.

FIG. 15 illustrates a wrap-around packaging container.

Figure 16:
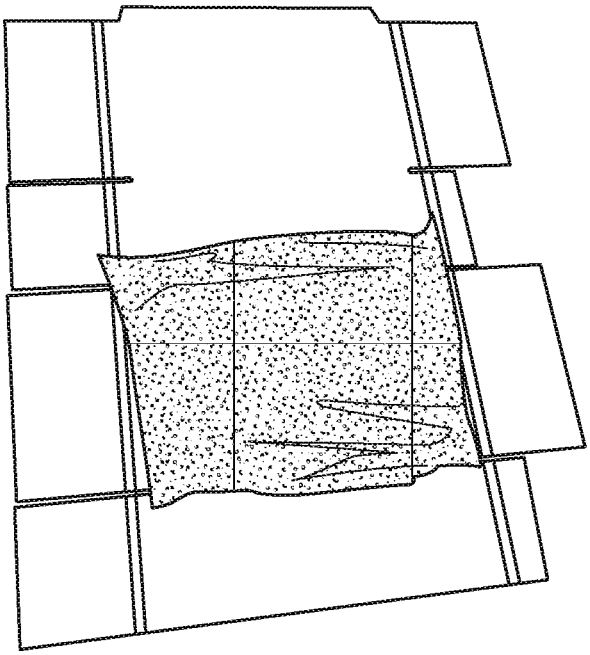
FIG. 16 illustrates a wrap-around packaging container with the filled packaging liner according to an embodiment of the present disclosure.

FIG. 16 illustrates a wrap-around packaging container with the packaging liner filled prior to erecting the packaging container.

Next, a method for assembling a packaging container or system is disclosed. As a preliminary matter it is noted that, while an order is given to the steps described herein, these steps may be undertaken in an alternative and/or different order to achieve the results provided herein. Furthermore, additional and/or alternative steps may be provided to replace and/or compliment the steps provided herein.

In an embodiment, a method for assembling a packaging container can include the steps of folding bottom flaps of the packaging container to enclose the bottom of the container, sealing the bottom flaps, folding the top flaps of the packaging container, and sealing the top flaps. In one aspect, a method for assembling a packaging system can include the above steps and can further include inserting a packaging liner before sealing the top or bottom flaps. In another aspect, the method can further include filling the packaging liner with a product. In still another aspect, the method can further include sealing the packaging liner.

In another embodiment, a method for assembling a packaging container can include the steps of folding bottom flaps of a packaging container to lay flat against exterior faces of the packaging container; shaping the packaging container so that the bottom flaps stay folded down against the exterior face of the packaging container; turning over the packaging container and closing the top of the packaging container. In one aspect, a method for assembling a packaging system can include the above steps and can further include inserting the packaging liner into the packaging container; filling the packaging liner with a product; optionally expelling air from the packaging liner; sealing the packaging liner; and closing a bottom of the packaging container. In one aspect, sealing the packaging liner can include using a heat or impulse sealer. In another aspect, nitrogen flushing can be used in addition to expelling air from the package for extending product shelf life.

In an embodiment, a method of assembling a packaging system includes the steps of assembling a packaging container using an FOL. In an embodiment, the step of closing the top or bottom of the packaging container includes the steps of folding down minor flaps first; folding down a first major flap, the first major flap not including the easy open tear notches; applying three ⅛"-¼" beads of hot melt to the inside of a second major flap; folding the second major flap down; turning the packaging container over so it stands on the glued end and applying even pressure for two seconds until the glue cools enough so that the bottom flaps remain closed. In such an embodiment, the method can further include applying the beads of hot melt ½" from the tear tape.

In an embodiment, any commercially available glue gun and glue stick can be used to apply the hot melt. In an embodiment, the hot melt can be applied using a 300 watt glue gun with temperature control up to 400° F. As an example, ½" glue sticks can be used. The glue can be FDA approved for food contact use. In an embodiment, the glue stick includes 50% bond strength at 1 minute, 75% at 1 hour, and 100% at 24 hours.

In an embodiment, the step of inserting the packaging liner into the packaging container includes cuffing the packaging liner over the end flaps to prevent the packaging liner from slipping into the packaging container during filling with product.

In an embodiment, when skip slots are present, the step of closing the bottom of the packaging container includes first cutting or breaking the material between the flaps and then folding the flaps up. In such an embodiment, the step of closing the bottom or the top of the packaging container further includes folding down the minor flaps first; folding down a first major flap, the first major flap not including the easy open tear notches; applying three ⅛"-¼" beads of hot melt to the inside of a second major flap; folding the second major flap down; turning the packaging container over so it stands on the glued end and applying even pressure for two seconds until the glue cools enough so that the bottom flaps remain closed. In such an embodiment, the method further includes applying the beads of hot melt ½" above the tear tape.

In an embodiment, the method may include the use of a hot melt quality check. In particular, after the flaps are closed and the glue sets and cools after one minute a fiber tear appears on both major flaps surfaces where there is hot melt when the major flaps on the ends of the packaging container are peeled apart. The hot melt quality check can be conducted before starting production and at the end of production.

In an embodiment, a method for assembling a packaging system in which the packaging liner is attached to the packaging container is provided. In an embodiment, the method includes sealing the packaging liner to the packaging container; folding bottom flaps of the packaging container to enclose the bottom of the container, sealing the bottom flaps, folding the top flaps of the packaging container, and sealing the top flaps. When using skip slots, the method can alternately include folding the bottom flaps of a packaging container to lay flat against exterior faces of the packaging container; assembling the packaging container so that the bottom flaps stay folded down against the exterior face of the packaging container; turning over the packaging container and closing the top of the packaging container; filling the packaging liner with a product; expelling the air from the packaging liner; sealing the packaging liner using a heat sealer; and closing the bottom of the packaging container.

In an embodiment, the method of assembling a packaging system includes filling the packaging liner prior to dropping the packing liner in an erected packaging container. In an embodiment, the method of assembling a packaging system includes filling the packaging liner and then using a wrap-around case. In such an embodiment, the wrap-around case is shipped flat without the manufacturer's glue joint and then the flat scored corrugated sheet is formed or wrapped around a filled packaging liner.

In an embodiment, the method may further include the step of laying down the filled packaging containers to be palletized. In an embodiment, the filled packaging containers are stacked five packaging containers per layer and five layers.

It should be understood that various changes and modifications to the examples described here will be apparent to those skilled in the art. Such changes and modifications can be made without departing from the spirit and scope of the present subject matter and without diminishing its intended advantages. It is therefore intended that such changes and modifications be covered by the appended claims. Further, the present embodiments are thus not to be limited to the precise details of methodology or construction set forth above as such variations and modification are intended to be included within the scope of the present disclosure. Moreover, unless specifically stated any use of the terms first, second, etc. do not denote any order or importance, but rather the terms first, second, etc. are merely used to distinguish one element from another.

What is claimed is:

1. A packaging container comprising:

a top face comprising a first side and further comprising a second side opposite from the first side, a width of the packaging container is defined by a distance from the first side of the top face to the second side of the top face, the top face is defined by a top outer flap that extends from the first side of the top face of the packaging container to the second side of the top face of the packaging container;

one or more carrying handles on the packaging container;

a first tear strip located on the top face of the packaging container as part of the top upper flap, the top outer flap further comprises a remnant flap formed by removal of the first tear strip, the remnant flap extending from the first side of the top face of the packaging container, and the top outer flap further comprises a major flap on an opposite side of the first tear strip from the remnant flap;

a top inner flap that extends from the second side of the top face of the packaging container, wherein a majority of the surface area of the inner side of the top outer flap is bonded with the top inner flap such that the removal of the first tear strip forms a full-width flap comprising both the top inner flap and the major flap, the full-width flap extends a full width of the distance from the second side of the top face to the first side of the top face, wherein the full-width flap formed by the removal of the first tear strip is a hinged lid extending from the second side of the top face and configured to fold away from the remaining portion of the packaging container to thereby allow a product in the packaging container to be dispensed and then the hinged lid is configured to be positioned underneath the remnant flap to restrain the full-width flap that is the hinged lid to thereby retain the packaging container in a reclosed position; and a second tear strip located on a bottom face of the packaging container, wherein the bottom face is opposite from the top face.

2. The packaging container according to claim 1, wherein the first tear strip comprises one or more tabs configured to allow a consumer to open the packaging container without the use of tools.

3. The packaging container according to claim 2, wherein the top outer flap consists of the remnant flap, the tear strip, the one or more tabs of the first tear strip, and the major flap.

4. The packaging container according to claim 1, wherein the packaging container is in the form of a full overlap slotted container.

5. The packaging container according to claim 1, wherein the packaging container is configured to be placed in an upright vertical orientation to display the packaging container on a smallest side of the packaging container.

6. The packaging container according to claim 1, wherein the one or more carrying handles are located up to about ⅓ of the way down from the top face of the packaging container.

7. The packaging container according to claim 1, further comprising personalized information on the packaging container, the personalized information regarding a product contained in the packaging container.

8. A packaging system comprising:

the packaging container of claim 1;

a packaging liner inside the packaging container.

9. The packaging system according to claim 8, wherein the first tear strip comprises one or more tabs configured to allow a consumer to open the packaging system without the use of tools.

10. The packaging system according to claim 9, wherein the top outer flap consists of the remnant flap, the tear strip, the one or more tabs of the first tear strip, and the major flap.

11. The packaging system according to claim 8, wherein the packaging liner is a hermetically sealed packaging liner configured to seal odors from a product contained within the packaging liner.

12. The packaging system according to claim 8, wherein the packaging container is in the form of a full overlap slotted container.

13. The packaging system according to claim 8, wherein the carrying handles are located up to about ⅓ of the way down from the top face of the packaging container.

14. The packaging system according to claim 8, wherein the one or more carrying handles comprise a second set of carrying handles located up to about ⅓ of the way up from the bottom face of the container.

15. The packaging system according to claim 8, wherein the container is a full overlap slotted container and is configured to be reclosed after the top face is opened by a consumer.

16. The packaging system according to claim 8, wherein the packaging liner is configured to retain a particulate material weighing about 20 to about 60 pounds.

17. The packaging system according to claim 8, wherein the packaging liner includes a U-shaped top seal and a tear notch.

* * * * *